US009401127B2

(12) United States Patent
Chen

(10) Patent No.: US 9,401,127 B2
(45) Date of Patent: Jul. 26, 2016

(54) IMAGE PROCESSING METHOD AND ANTI-SATURATION METHOD FOR IMAGE DATA AND IMAGE PROCESSING DEVICE

(71) Applicant: Novatek Microelectronics Corp., Hsinchu (TW)

(72) Inventor: Hsing-Chuan Chen, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 206 days.

(21) Appl. No.: 14/070,582

(22) Filed: Nov. 4, 2013

(65) Prior Publication Data

US 2015/0009228 A1 Jan. 8, 2015

(30) Foreign Application Priority Data

Jul. 2, 2013 (TW) ..... 102123702 U

(51) Int. Cl.
*G09G 5/10* (2006.01)

(52) U.S. Cl.
CPC ..... *G09G 5/10* (2013.01); *G09G 2320/0271* (2013.01); *G09G 2320/066* (2013.01); *G09G 2360/16* (2013.01)

(58) Field of Classification Search
CPC .. H04N 5/52; H04N 1/32251; H04N 1/40087
See application file for complete search history.

(56) References Cited

U.S. PATENT DOCUMENTS 6,677,959 B1 1/2004 James
9,077,905 B2 * 7/2015 Fukui ..... H04N 5/23219
9,087,485 B2 7/2015 Ahn et al.
2002/0140865 A1 10/2002 Matsushita et al.
2007/0071345 A1 * 3/2007 Wang ..... G06T 5/009 382/254
2008/0180385 A1 * 7/2008 Yoshida ..... G09G 3/20 345/102
2011/0141166 A1 6/2011 Ahn et al.

(Continued)

FOREIGN PATENT DOCUMENTS

CN 1774077 5/2006
CN 102097068 6/2011

(Continued)

OTHER PUBLICATIONS

"Notice of Allowance of Taiwan Counterpart Application," issued on Oct. 29, 2015, p. 1-p. 4, in which the listed references were cited.

(Continued)

*Primary Examiner* — Antonio A Caschera
(74) *Attorney, Agent, or Firm* — Jianq Chyun IP Office

(57) ABSTRACT

The image processing method includes: analyzing an image frame to obtain an original gain value corresponding to grayscale values of the image frame, wherein the original gain value is greater than 1; obtaining a lookup table recording conversion relationship between default grayscale values and default gain values, wherein the lookup table is used for performing anti-saturation processing on image data of the image frame; according to the original gain value, performing anti-saturation processing for the image frame by using the lookup table to obtain an adjusted conversion relationship of the image frame, wherein the adjusted conversion relationship defines a conversion relationship between different grayscale values of the image frame and corresponding adjusted gain values; and performing gain processing on image data of the image frame according to the adjusted conversion relationship.

30 Claims, 6 Drawing Sheets

(56) References Cited

U.S. PATENT DOCUMENTS

| | | | |
|---|---|---|---|
| 2012/0293473 | A1 | 11/2012 | Lee et al. |
| 2013/0069929 | A1 | 3/2013 | English et al. |
| 2013/0071022 | A1 | 3/2013 | Jia et al. |

FOREIGN PATENT DOCUMENTS

| | | |
|---|---|---|
| CN | 103021375 | 4/2013 |
| JP | 2003199117 | 7/2003 |
| TW | 200945910 | 11/2009 |
| TW | 201248604 | 12/2012 |

OTHER PUBLICATIONS

"Office Action of China Counterpart Application", issued on Mar. 23, 2016, p. 1-p. 12, in which the listed references were cited.

* cited by examiner

IMAGE PROCESSING METHOD AND ANTI-SATURATION METHOD FOR IMAGE DATA AND IMAGE PROCESSING DEVICE

CROSS-REFERENCE TO RELATED APPLICATION

This application claims the priority benefit of Taiwan application serial no. 102123702, filed on Jul. 2, 2013. The entirety of the above-mentioned patent application is hereby incorporated by reference herein and made a part of this specification.

BACKGROUND

1. Technical Field

The invention relates to an image processing device. Particularly, the invention relates to an image processing method, an anti-saturation method for image data and an image processing device using the same.

2. Related Art

FIG. 1 illustrates a conventional image processing device. A global gain generator 110 determines a gain value G according to an operation requirement of the system, and outputs the gain value G to a calculation circuit 120. The calculation circuit 120 receives original image data $D_1$, and calculates a multiplication of the gain value G and the image data $D_1$, and outputs the multiplication (i.e. $G*D_1$) to a display circuit 130 to server as new image data $D_2$. The display circuit 130 drives a display panel to display a corresponding image frame according to the image data $D_2$.

Under a normal operation condition, the global gain generator 110 sets the gain value G to 1. FIG. 2 illustrates a conversion curve between the image data $D_1$ and the image data $D_2$ when the gain value G of FIG. 1 is 1. In FIG. 2, a horizontal axis represents the original image data $D_1$, and a vertical axis represents the new image data $D_2$ converted by the calculation circuit 120. It is assumed that the image data $D_1$ and the image data $D_2$ are all 8-bit data. Under the condition that the gain value G is 1, a value range of the image data $D_1$ is 0-255, and a value range of $G*D_1$ (i.e. the image data $D_2$) is also 0-255.

When the global gain generator 110 sets the gain value G to be greater than 1 (for example, 1.2), the new image data $D_2$ converted by the calculation circuit 120 probably has a phenomenon of saturation. FIG. 3 illustrates a conversion curve between the image data $D_1$ and the image data $D_2$ when the gain value G of FIG. 1 is 1.2. In FIG. 3, a horizontal axis represents the original image data $D_1$, and a vertical axis represents the new image data $D_2$ converted by the calculation circuit 120. It is assumed that the image data $D_1$ and the image data $D_2$ are all 8-bit data. Under the condition that the gain value G is 1.2, a value range of the image data $D_1$ is 0-255, and a value range of $G*D_1$ (i.e. the image data $D_2$) is 0-366. However, since the image data $D_2$ is the 8-bit data, i.e. a maximum value of the image data $D_2$ is 255, when the image data D1 is within a range of 213-255, the image data $D_2$ are all 255, and such phenomenon is the so-called "saturation". Since the image data $D_2$ has the phenomenon of saturation, details of a high grayscale (high brightness) image frame are disappeared. The greater the gain value G is, the greater the value range having the saturation phenomenon is, and the more severe the detail loss of the high brightness image frame is.

SUMMARY

Accordingly, the invention is directed to an image processing method, an anti-saturation method for image data and an image processing device using the same, by which saturation of image data is avoided.

The invention provides an image processing method, configured to perform image processing on image data of a plurality of image frames of an image processing device. Each of the image frames includes a plurality of pixel units, and each of the pixel units includes a plurality of sub pixels respectively corresponding to a plurality of colors. The image processing method includes following steps. One of the image frames is analyzed to obtain an original gain value corresponding to a plurality of grayscale values of the image frame, where the original gain value is greater than 1. A default data-gain conversion relationship lookup table is obtained, where the default data-gain conversion relationship lookup table records a plurality of default grayscale values and a plurality of corresponding default gain values, and is commonly used for performing an anti-saturation processing on image data of the image frames. According to the original gain value, the anti-saturation processing is performed on the image frame by using the default data-gain conversion relationship lookup table to obtain an adjusted data-gain conversion relationship of the image frame, where the adjusted data-gain conversion relationship define a conversion relationship between different grayscale values of the image frame and corresponding adjusted gain values. A gain processing is performed on the image data of the image frame according to the adjusted data-gain conversion relationship.

The invention provides an anti-saturation method for image data, which is adapted to an image processing device to perform an image processing. The anti-saturation method for image data includes following steps. One of a plurality of image frames is analyzed to obtain an original conversion relationship curve of the image frame, and the original conversion relationship curve represents a gain processing of a plurality of grayscale values of the image frame commonly according to an original gain value, where the original gain value is greater than 1. A default conversion relationship curve is obtained, where the default conversion relationship curve is commonly used for performing an anti-saturation processing on image data of the image frames. The default conversion relationship curve and the original conversion relationship curve are combined to perform the anti-saturation processing on the image frame, so as to obtain an adjusted conversion relationship curve. A gain processing is performed on the image data of the image frame according to the adjusted conversion relationship curve.

The invention provides an image processing device, configured to perform image processing on image data of a plurality of image frames. Each image frame includes a plurality of pixel units, and each pixel unit includes a plurality of sub pixels respectively corresponding to a plurality of colors. The image processing device includes a global gain generator, a conversion relationship generator and a conversion circuit. The global gain generator analyzes one of the image frames to obtain an original gain value corresponding to grayscale values of the image frame, where the original gain value is greater than 1. The conversion relationship generator is coupled to the global gain generator for receiving the original gain value. The conversion relationship generator obtains a default data-gain conversion relationship lookup table, where the default data-gain conversion relationship lookup table records a plurality of default grayscale values and a plurality of corresponding default gain values, and is commonly used for performing an anti-saturation processing on image data of the image frames. The conversion relationship generator performs the anti-saturation processing on the image frame by using the default data-gain conversion relationship lookup table according to the original gain value to obtain an adjusted data-gain conversion relationship of the image frame, where the adjusted data-gain conversion relationship define a conversion relationship between different grayscale values of the image frame and corresponding adjusted gain values. The conversion circuit is coupled to the conversion relationship generator, and performs a gain processing on the image data of the image frame according to the adjusted data-gain conversion relationship.

The invention provides an image processing device, configured to perform an image processing. The image processing device includes a global gain generator, a conversion relationship generator and a conversion circuit. The global gain generator analyzes one of image frames to obtain an original conversion relationship curve of the image frame, where the original conversion relationship curve represents a gain processing of a plurality of grayscale values of the image frame commonly according to an original gain value, where the original gain value is greater than 1. The conversion relationship generator is coupled to the global gain generator for receiving the original gain value. The conversion relationship generator obtains a default conversion relationship curve, where the default conversion relationship curve is commonly used for performing an anti-saturation processing on image data of the image frames. The conversion relationship generator combines the default conversion relationship curve and the original conversion relationship curve to perform the anti-saturation processing on the image frame, so as to obtain an adjusted conversion relationship curve. The conversion circuit is coupled to the conversion relationship generator, and performs a gain processing on the image data of the image frame according to the adjusted conversion relationship curve.

According to the above descriptions, the image processing method, the anti-saturation method for image data and the image processing device using the same combine at least two conversion curves (or conversion relationships) to determine the gain value used for image data conversion, so as to avoid saturation of the image data to main high brightness details in the image frame.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
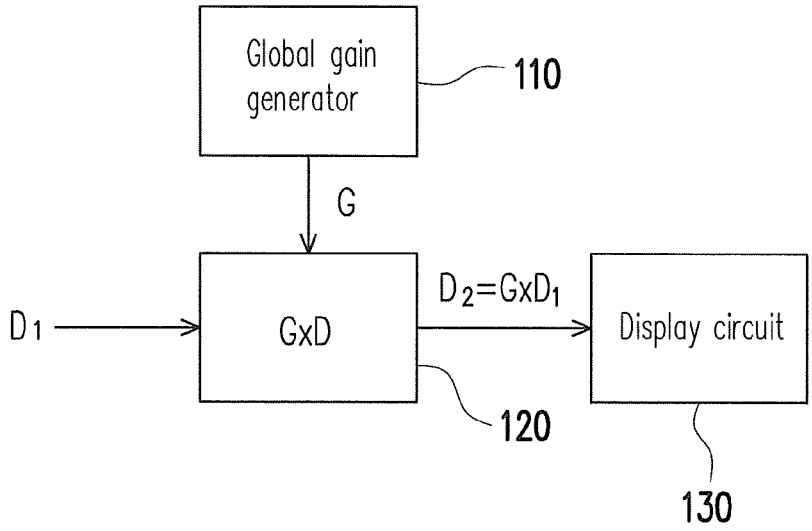
FIG. 1 (RELATED ART)
FIG. 1 illustrates a conventional image processing device.

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 4:
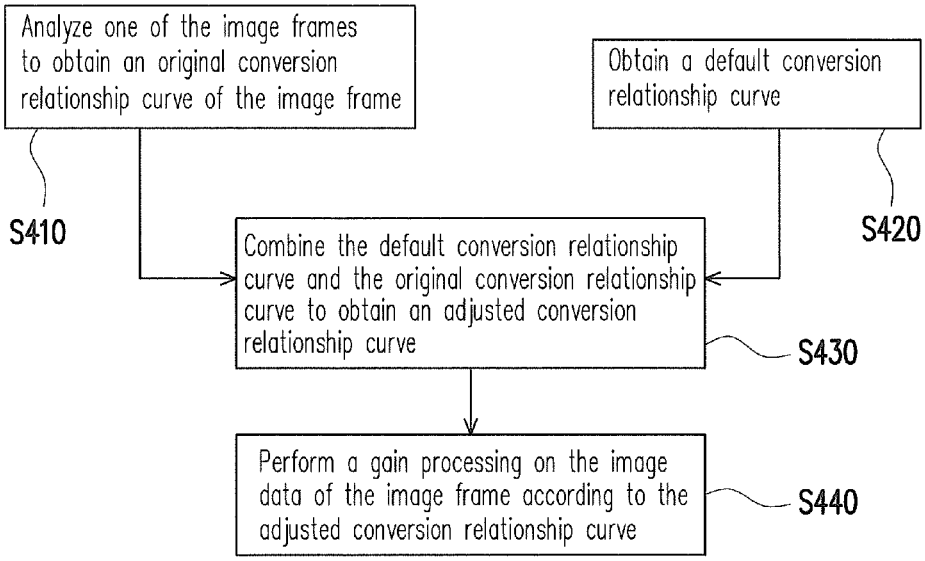
FIG. 4 is a flowchart illustrating an anti-saturation method for image data according to an embodiment of the invention.
Figure 5:
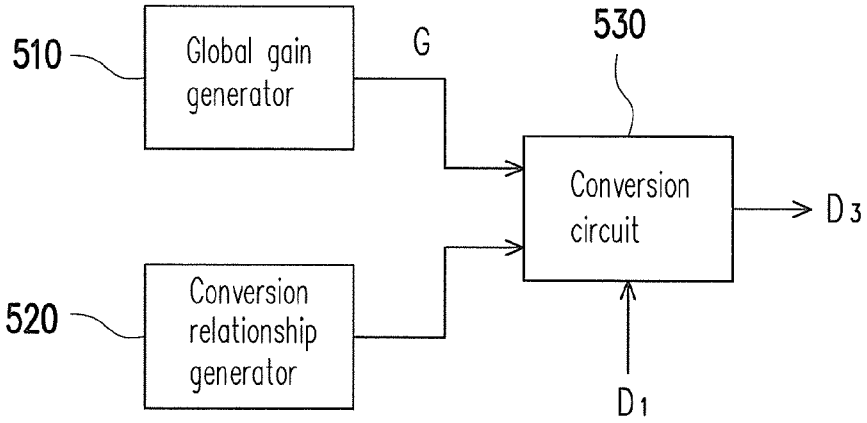
FIG. 5 is a circuit block diagram of an image processing device according to an embodiment of the invention.

FIG. 4 is a flowchart illustrating an anti-saturation method for image data according to an embodiment of the invention. FIG. 5 is a circuit block diagram of an image processing device according to an embodiment of the invention. Referring to FIG. 4 and FIG. 5, the image processing device includes a global gain generator 510, a conversion relationship generator 520 and a conversion circuit 530. The image processing device is configured to perform image processing on image data of a plurality of image frames, where the image frames respectively include a plurality of pixel units, and each pixel unit includes a plurality of sub pixels respectively corresponding to a plurality of colors.

Figure 2:
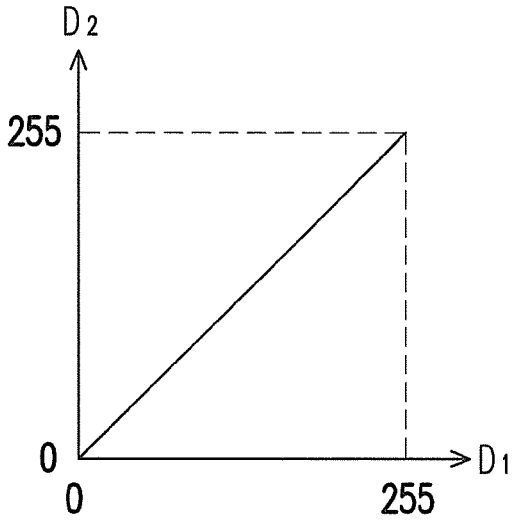
FIG. 2 (RELATED ART)
FIG. 2 illustrates a conversion relationship curve between image data $D_1$ and image data $D_2$ when an original gain value G of FIG. 1 is 1.
Figure 3:
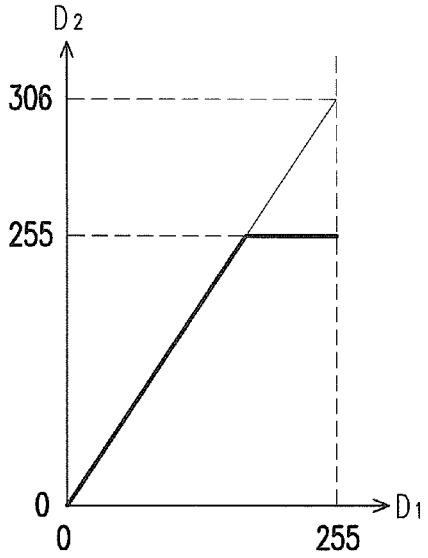
FIG. 3 (RELATED ART)
FIG. 3 illustrates a conversion relationship curve between image data $D_1$ and image data $D_2$ when an original gain value G of FIG. 1 is 1.2.

The conversion circuit 530 is coupled to the global gain generator 510 and the conversion relationship generator 520. The global gain generator 510 can be deduced according to related descriptions of the global gain generator 110 of FIG. 1. In step S410, the global gain generator 510 analyzes one of the image frames to obtain an original conversion relationship curve of the image frame. The original conversion relationship curve represents a gain processing of a plurality of grayscale values of the image frame commonly according to an original gain value G. In some embodiments, the original conversion relationship curve can be a data-data curve, which defines a corresponding relationship between the grayscale values before the gain conversion and the grayscale values after the gain conversion. For example, FIG. 2 and FIG. 3 can be regarded as special examples of the original conversion relationship curve. The global gain generator 510 may provide the original gain value G of the original conversion relationship curve to the conversion circuit 530.

When the original gain value G is not greater than 1, the original gain value G does not lead to saturation of the image data $D_3$, and the conversion circuit 530 can select to use the original conversion relationship curve representing the original gain value G to convert the original image data $D_1$ to the new image data $D_3$. A conversion method that the conversion circuit 530 converts the original image data $D_1$ to the new image data $D_3$ is not limited by the present embodiment. For example, the conversion circuit 530 selects/produces a corresponding lookup table (LUT) according to the original gain value G (the original conversion relationship curve), and uses the corresponding LUT to convert the original image data $D_1$ to the new image data $D_3$. For another example, the conversion circuit 530 can calculate a multiplication of the original gain value G and the image data $D_1$ (i.e. G*D1) to serve as the image data $D_3$. The conversion circuit 530 can output the image data $D_3$ to the display circuit (not shown). The display circuit can drive a display panel (not shown) to display a corresponding image frame according to the image data $D_3$.

Figure 6:
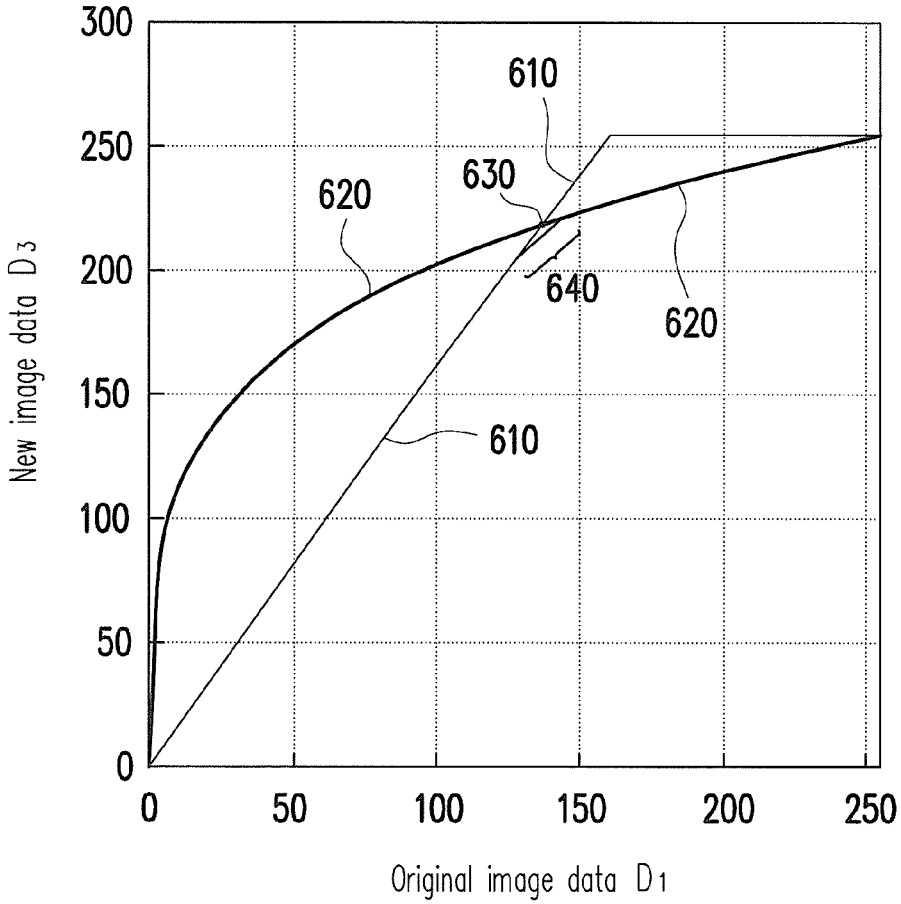
FIG. 6 is a schematic diagram of a conversion relationship curve between original image data $D_1$ and new image data $D_3$ when an original gain value G of FIG. 5 is 1.6 according to an embodiment of the invention.

In step S420, the conversion relationship generator 520 can obtain a default conversion relationship curve, where the default conversion relationship curve is commonly used for performing an anti-saturation processing on image data of the image frames. The default conversion relationship curve can be determined according to a design requirement. For example, in some embodiments, if the original conversion relationship curve is a data-data curve, the default conversion relationship curve can be the data-data curve, where a slope of the default conversion relationship curve is greater than 0 and smaller than or equal to 1 within a high grayscale (high brightness) range at least covering a highest grayscale value applied by the image processing device. Therefore, when the original gain value G provided by the global gain generator 510 is greater than 1, i.e. when the slope of the original conversion relationship curve is greater than 1, the original conversion relationship curve and the default conversion relationship curve have an intersection. For example, FIG. 6 is a schematic diagram of a conversion relationship curve between the original image data $D_1$ and the new image data $D_3$ when the original gain value G of FIG. 5 is 1.6 according to an embodiment of the invention. In FIG. 6, a horizontal axis represents the original image data $D_1$, and a vertical axis represents the new image data $D_3$ converted by the conversion circuit 530. It is assumed that the image data $D_1$ and the image data $D_3$ all have 8 bits, so that a value range of the image data $D_1$ is 0-255, and a value range of the image data $D_3$ is also 0-255. A curve 610 represents the original conversion relationship curve corresponding to the original gain value G. As that shown in FIG. 6, the original conversion relationship curve 610 includes an oblique line with a slope equal to the original gain value G and a horizontal line with a slope equal to 0. Obviously, under the condition that the original gain value G is 1.6, the original conversion relationship curve 610 representing the original gain value G has a phenomenon of "saturation" when the image data $D_1$ is within a range of 160-255.

In FIG. 6, the default conversion relationship curve 620 provided by the conversion relationship generator 520 is illustrated, where within the high grayscale (high brightness) range, the slope of the default conversion relationship curve 620 is greater than 0, and even all slopes of the default conversion relationship curve 620 are greater than 0. Therefore, the default conversion relationship curve 620 does not have the phenomenon of "saturation". The default conversion relationship curve 620 may serve as a set of maximum gain values accepted by system. The default conversion relationship curve 620 can be determined according to an actual product design. In the present embodiment, the image data of different colors of the image frame may use different default conversion relationship curves 620. The default conversion relationship curve 620 can be implemented by a LUT or other manner. Since the original gain value G provided by the global gain generator 510 is greater than 1 (for example, G=1.6), the original conversion relationship curve 610 and the default conversion relationship curve 620 have an intersection 630 there between. Within a low grayscale value range where the grayscale values before conversion (the image data $D_1$) are smaller than an intersection grayscale value corresponding to the intersection 630, the converted grayscale values (the image data $D_3$) on the original conversion relationship curve 610 are all smaller than or equal to the converted gain values (the image data $D_3$) on the default conversion relationship curve 620, and within a high grayscale value range where the grayscale values before conversion (the image data $D_1$) are greater than the intersection grayscale value corresponding to the intersection 630, the converted grayscale values (the image data $D_3$) on the original conversion relationship curve 610 are all greater than or equal to the converted gain values (the image data $D_3$) on the default conversion relationship curve 620.

Referring to FIG. 4 and FIG. 5, when the original gain value G provided by the global gain generator 510 is greater than 1, the original gain value G probably leads to saturation of the image data $D_3$, and the conversion circuit 530 can dynamically select to use the original conversion relationship curve representing the original gain value G or the default conversion relationship curve provided by the conversion relationship converter 520 to convert the original image data $D_1$ to the new image data $D_3$. The conversion circuit 530 can execute a step S430 to combine the default conversion relationship curve and the original conversion relationship curve to perform the anti-saturation processing on the image frame, so as to obtain an adjusted conversion relationship curve. In some embodiments, the adjusted conversion relationship curve can be a data-data curve, which defines a corresponding relationship between the grayscale values before the gain conversion and the grayscale values after the gain conversion.

For example, as that shown in FIG. 6, when the image data D1 is smaller than the intersection 630, the conversion circuit 530 can select to use the original conversion relationship curve 610 to serve as the adjusted conversion relationship curve, so as to convert the original image data $D_1$ to the new image data $D_3$. When the image data $D_1$ is greater than the intersection 630, the conversion circuit 530 can select to use the default conversion relationship curve 620 to serve as the adjusted conversion relationship curve, so as to convert the original image data $D_1$ to the new image data $D_3$. Namely, the conversion circuit 530 can select a part of line segment of the original conversion relationship curve 610 with grayscale values (the image data $D_1$) lower than the intersection grayscale value corresponding to the intersection 630 of the default conversion relationship curve 620 and the original conversion relationship curve 610 to serve as a first part of the adjusted conversion relationship curve, and selects a part of line segment of the default conversion relationship curve 620 with grayscale values higher than the intersection grayscale value to serve as a second part of the adjusted conversion relationship curve.

For another example, the conversion circuit 530 can perform a smooth processing on the adjusted conversion relationship curve, such that the parts of line segments on the adjusted conversion relationship curve covering the original conversion relationship curve 610 and the default conversion relationship curve 620 may have a smooth connection. The conversion circuit 530 may define an "intersection range", where the intersection of the original conversion relationship curve and the default conversion relationship curve is within the intersection range. In the step S430, the conversion circuit 530 can compare the image data $D_1$ with an intersection range (for example, an intersection range 640 shown in FIG. 6). In the embodiment of FIG. 6, the conversion circuit 530 can perform the smooth processing on the original conversion relationship curve 610 and the default conversion relationship curve 620 in the intersection range 640, such that the original conversion relationship curve 610 and the default conversion relationship curve 620 have a smooth connection there between. In some embodiments, the smooth processing includes a low pass filtering. The conversion circuit 530 can also convert the original conversion relationship curve 610 and the default conversion relationship curve 620 in the intersection range 640 into a smooth connection line by using the low pass filtering, as that shown in FIG. 6. Therefore, when the image data $D_1$ falls in the intersection range 640, the conversion circuit 530 can select to use the smooth connection line to convert the image data $D_1$ to the image data $D_3$.

After the step S430 is completed, the conversion circuit 530 executes a step S440 to perforin a gain processing on the image data $D_1$ of the image frame according to the adjusted conversion relationship curve. For example, when the image data $D_1$ is smaller than the intersection range 640, the conversion circuit 530 can select to use the original conversion relationship curve 610 to convert the image data $D_1$ to the image data $D_3$. When the image data $D_1$ is greater than the intersection range 640, the conversion circuit 530 can select to use the default conversion relationship curve 620 to convert the image data $D_1$ to the image data $D_3$. When the image data $D_1$ falls in the intersection range 640, the conversion circuit 530 can select to use the smooth connection line of the intersection range 640 to convert the image data $D_1$ to the image data $D_3$.

The original conversion relationship curve, the default conversion relationship curve and the adjusted conversion relationship curve of the present invention are not limited to related descriptions of the exemplary embodiment of FIG. 6. For example, in some other embodiments, the original conversion relationship curve, the default conversion relationship curve and the adjusted conversion relationship curve can be data-data gain curves. In the high grayscale range at least covering the highest grayscale value applied by the image processing device, at least one corresponding gain value on the default conversion relationship curve is greater than 0 and is smaller than or equal to 1.

Figure 7:
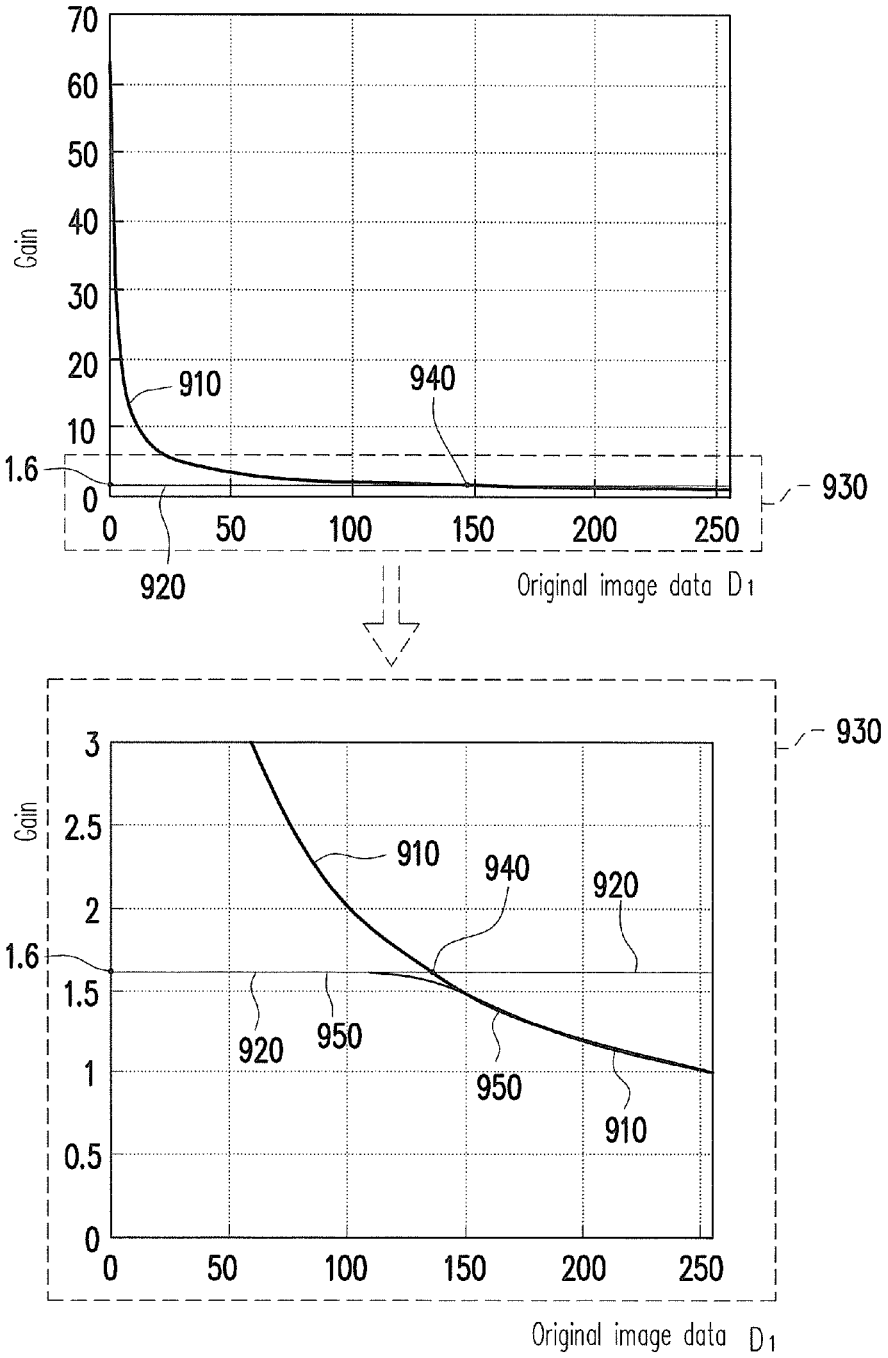
FIG. 7 is a schematic diagram of a conversion relationship curve of original image data $D_1$ and gain values when the original gain value G of FIG. 5 is 1.6 according to an embodiment of the invention.

FIG. 7 is a schematic diagram of a conversion relationship curve of the original image data $D_1$ and the gain values when the original gain value G of FIG. 5 is 1.6 according to an embodiment of the invention. In FIG. 7, the horizontal axis represents the original image data $D_1$, and the vertical axis represents the gain values. A curve 910 of FIG. 7 represents the default conversion relationship curve provided by the relationship generator 520. In the present embodiment, image data of different colors of the image frame may use different default conversion relationship curve 910. A curve 920 of FIG. 7 represents the original conversion relationship curve corresponding to the original gain value G (for example, G=1.6). In the present embodiment, the original conversion relationship curve 920 is a horizontal line passing through the original gain value G.

A lower part of FIG. 7 is an enlarged view of a region 930 in an upper part of FIG. 7. It is assumed that the image data $D_1$ and the image data $D_3$ are all 8-bit data, so that the value range of the image data $D_1$ and the image data $D_3$ is 0-255. When the original image data $D_1$ has the maximum value (i.e. 255), a default gain value of the default conversion relationship curve 910 is 1. Moreover, in the low grayscale range at least covering the minimum grayscale value applied by the image processing device, i.e. in the low grayscale (low brightness) range of the image data $D_1$, at least one corresponding gain value on the default conversion relationship curve 910 is greater than the original gain value G provided by the global gain generator 510. Therefore, when the original gain value G provided by the global gain generator 510 is greater than 1 (for example, G=1.6), the predetermined conversion relationship curve 910 and the original conversion relationship curve 920 representing the original gain value G have an intersection 940 there between.

Since the original gain value G is greater than 1, the original conversion relationship curve 920 may have the phenomenon of "saturation) in the high grayscale (high brightness) range of the image data $D_1$. Since the gain value of the default conversion relationship curve 910 in the high grayscale (high brightness) range of the image data $D_1$ is converged to 1, the default conversion relationship curve 910 does not have the phenomenon of "saturation". The default conversion relationship curve 910 may serve as a set of the maximum gain values that can be accepted by the system. The default conversion relationship curve 910 can be determined according to an actual product design. The default conversion relationship curve 910 can be implemented through a LUT manner or other manner.

Referring to FIG. 5 and FIG. 7, when the original gain value G provided by the global gain generator 510 is greater than 1, the original gain value G probably leads to saturation of the image data $D_3$, so that the conversion circuit 530 can dynamically select to use the original conversion relationship curve 920 or the default conversion relationship curve 910 according to the image data $D_1$, so as to convert the original image data $D_1$ to the gain value. For example, as that shown in FIG. 7, when the image data $D_1$ is smaller than the intersection 940, the conversion circuit 530 can select to use the original conversion relationship curve 920 to serve as a first part of the adjusted conversion relationship curve 950, so as to convert the original image data $D_1$ to the gain value. When the image data $D_1$ is greater than the intersection 940, the conversion circuit 530 can select to use the default conversion relationship curve 910 to serve as a second part of the adjusted conversion relationship curve 950, so as to convert the original image data $D_1$ to the gain value. The conversion circuit 530 can also use the gain values of the adjusted conversion relationship curve 950 to convert the image data $D_1$ to the image data $D_3$. Since the gain value of the adjusted conversion relationship curve 950 in the high grayscale (high brightness) range of the image data $D_1$ is converged to 1, it is ensured that the gained image data $D_3$ does not have the phenomenon of "saturation".

In the embodiment of FIG. 7, the conversion circuit 530 can select a part of the default conversion relationship curve 910 with the gain values smaller than the original gain value G (for example, 1.6), and select a part of the original conversion relationship curve 920 with the image data $D_1$ smaller than the intersection 940 to serve as the adjusted conversion relationship curve 950. In the embodiment of FIG. 7, the conversion circuit 530 can also perform a smooth processing on the adjusted conversion relationship curve 950, such that the adjusted conversion relationship curve 950 has a smooth connection, as that shown in FIG. 7. For example, in some embodiments, the smooth processing includes a low pass filtering processing.

Figure 8:
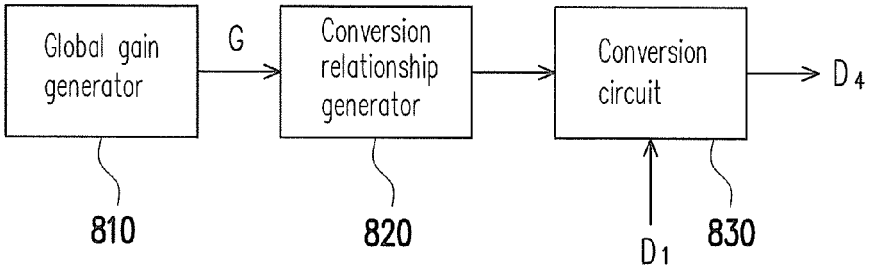
FIG. 8 is a circuit block diagram of an image processing device according to another embodiment of the invention.

Implementation of the image processing device is not limited to related descriptions of FIG. 5. For example, FIG. 8 is a circuit block diagram of an image processing device according to another embodiment of the invention. The embodiment of FIG. 8 can be deduced by referring to related descriptions of the embodiment of FIG. 5. Referring to FIG. 4 and FIG. 8, the image processing device includes a global gain generator 810, a conversion relationship generator 820 and a conversion circuit 830. The conversion relationship generator 820 is coupled to the global gain generator 810 for receiving the original gain value G, i.e. receiving the original conversion relationship curve (for example, the original conversion relationship curve 610 of FIG. 6 or the original conversion relationship curve 920 of FIG. 7).

Description of the global gain generator 810 can be deduced by referring to the related description of the global gain generator 110 of FIG. 1 or the global gain generator 510 of FIG. 5. In the step S410, the global gain generator 810 determines the original gain value G according to an operation requirement of the system, and provides the original gain value G to the conversion relationship generator 820.

The conversion relationship generator 820 is coupled to the conversion circuit 830. When the original gain value G is not greater than 1, the original gain value G does not lead to saturation of the image data $D_4$, and the conversion relationship generator 820 selects to transmit the original gain value G provided by the global gain generator 810 to the conversion circuit 830. The conversion circuit 830 can convert the original image data $D_1$ to the new image data $D_4$ according to the original gain value G transmitted by the conversion relationship generator 820. The conversion method that the conversion circuit 830 converts the original image data $D_1$ to the new image data $D_4$ is not limited by the invention. For example, the conversion circuit 830 selects/produces a corresponding lookup table (LUT) according to the original gain value G, and uses the corresponding LUT to convert the original image data $D_1$ to the new image data $D_4$. For another example, the conversion circuit 830 can calculate a multiplication of the original gain value G and the image data $D_1$ (i.e. G*D1) to serve as the image data $D_4$. The conversion circuit 830 can output the image data $D_4$ to the display circuit (not shown). The display circuit can drive a display panel (not shown) to display a corresponding image frame according to the image data $D_4$.

In the step S420, the conversion relationship generator 820 obtains the default conversion relationship curve (for example, the default conversion relationship curve 620 of FIG. 6 or the default conversion relationship curve 910 of FIG. 7), where the default conversion relationship curve is commonly used for performing an anti-saturation processing on image data of the image frames.

In the step S430, the conversion relationship generator 820 combines the default conversion relationship curve of the step S420 and the original conversion relationship curve of the step S410 to perform the anti-saturation processing on the image frame, so as to obtain the adjusted conversion relationship curve. For example, taking FIG. 6 as an example, referring to FIG. 6 and FIG. 8, in the step S430, the conversion relationship generator 820 can perform the anti-saturation processing on the image frame by using the default conversion relationship curve 620 and the original conversion relationship curve 610, so as to obtain the adjusted conversion relationship curve. For another example, taking FIG. 7 as an example, referring to FIG. 7 and FIG. 8, in the step S430, the conversion relationship generator 820 can perform the anti-saturation processing on the image frame by using the default conversion relationship curve 910 and the original conversion relationship curve 920, so as to obtain the adjusted conversion relationship curve 950.

After the step S430 is completed, the conversion circuit 830 may execute the step S440 to perform the gain processing on the image data of the image frame according to the adjusted conversion relationship curve.

Figure 9:
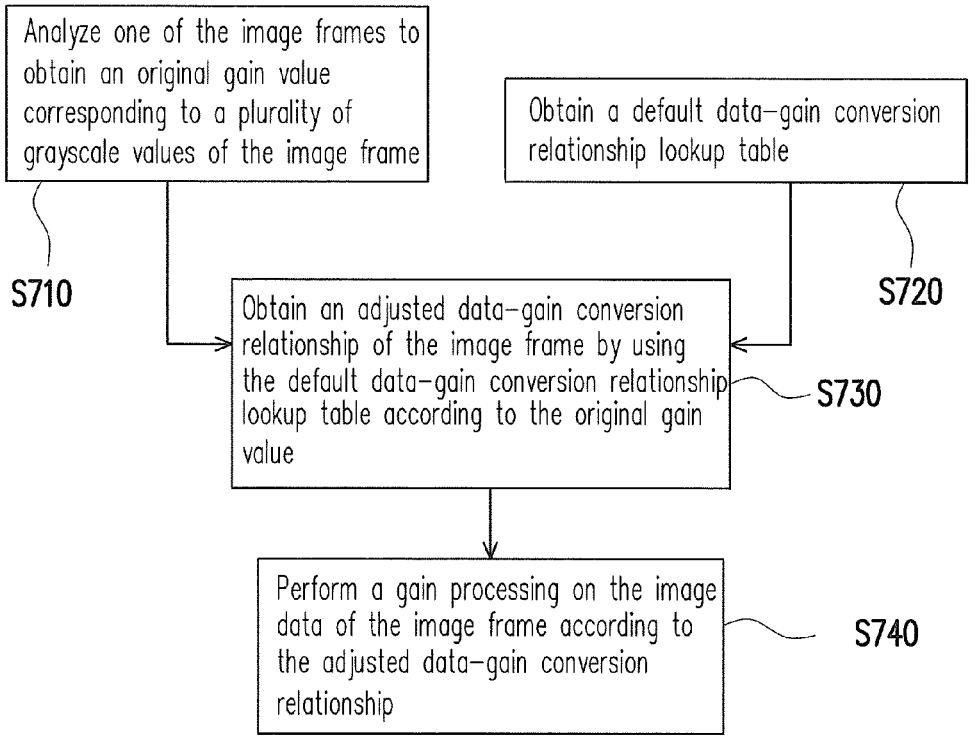
FIG. 9 is a flowchart illustrating an anti-saturation method for image data according to another embodiment of the invention.

Implementation of the image processing method is not limited to the related descriptions of FIG. 4. For example, FIG. 9 is a flowchart illustrating an anti-saturation method for image data according to another embodiment of the invention. The embodiment of FIG. 9 can be deduced according to the related description of FIG. 4. The method of FIG. 9 can be applied to the image processing device of FIG. 5 or the image processing device of FIG. 8.

Referring to FIG. 5 and FIG. 9, the image processing device can perform image processing on image data of a plurality of image frames, where each of the image frames includes a plurality of pixel units, and each of the pixel units includes a plurality of sub pixels respectively corresponding to a plurality of colors. The image processing device includes the global gain generator 510, the conversion relationship generator 520 and the conversion circuit 530. The global gain generator 510 can execute a step S710 to analyze one of the image frames to obtain the original gain value G corresponding to a plurality of grayscale values of the image frame. For example, taking FIG. 7 as an example, the original gain value G of the step S710 can be the original conversion relationship curve 920.

In step S720, the conversion circuit 530 may obtain a default data-gain conversion relationship lookup table provided by the conversion relationship generator 520, where the default data-gain conversion relationship lookup table records a plurality of default grayscale values and a plurality of corresponding default gain values. The default data-gain conversion relationship lookup table is commonly used for performing an anti-saturation processing on image data of a plurality of image frames. Taking FIG. 7 as an example, in the step S720, the default data-gain conversion relationship lookup table may record the default conversion relationship curve 910.

In step S730, the conversion circuit 530 performs the anti-saturation processing on the image frame by using the default data-gain conversion relationship lookup table of the step S720 according to the original gain value of the step S710 to obtain an adjusted data-gain conversion relationship of the image frame, where the adjusted data-gain conversion relationship define a conversion relationship between different grayscale values of the image frame and corresponding adjusted gain values. For example, taking FIG. 7 as an example, the adjusted data-gain conversion relationship of the step S730 can be the adjusted conversion relationship curve 950.

In step S740, the conversion circuit 530 performs a gain processing on the image data of the image frame according to the adjusted data-gain conversion relationship obtained in the step S730. Implementation of the step S740 is not limited by the invention. For example, the conversion circuit 530 can obtain a plurality of grayscale values of the image frame, and obtain a plurality of adjusted gain values respectively corresponding to the grayscale values of the image frame according to the adjusted data-gain conversion relationship obtained in the step S730, and the conversion circuit 530 respectively performs the gain processing on a plurality of grayscale values of the image frame.

The method of FIG. 9 can also be applied to the image processing device of FIG. 8. Referring to FIG. 8 and FIG. 9, the global gain generator 810 analyzes the image frame to obtain the original gain value G corresponding to a plurality of grayscale values of the image frame. The conversion relationship generator 820 is coupled to the global gain generator 810 to receive the original gain value G. For example, taking FIG. 7 as an example, the original gain value G of the step S710 can be the original conversion relationship curve 920.

In the step S720, the conversion relationship generator 820 obtains the default data-gain conversion relationship lookup table. For example, taking FIG. 7 as an example, the default data-gain conversion relationship lookup table of the step S720 records the default conversion relationship curve 910.

In step S730, the conversion relationship generator 820 performs the anti-saturation processing on the image frame by using the default data-gain conversion relationship lookup table of the step S720 according to the original gain value G to obtain an adjusted data-gain conversion relationship of the image frame. In the present embodiment, in the step S730, the adjusted gain values corresponding to at least one higher grayscale value in the grayscale values of the image frame are set to be equal to the default gain values, and the adjusted gain values corresponding to at least one lower grayscale value in the grayscale values of the image frame are set to be equal to the original gain value. For example, the conversion relationship generator 820 can directly use the default grayscale values belonging to a lower gain range in the default data-gain conversion relationship lookup table and the corresponding default gain values, and the conversion relationship generator 820 can set the adjusted gain values corresponding to all of the grayscale values in a higher gain range to the original gain value, so as to obtain the higher gain range of the adjusted data-gain conversion relationship. The lower gain range includes at least one gain value, and a lower boundary gain value of the lower gain range corresponds to the highest grayscale value used by the image processing device. The higher gain range includes at least one gain value, and a higher boundary gain value of the higher gain range corresponds to the minimum grayscale value used by the image processing device.

The conversion relationship generator 820 obtains a specific gain value according to at least one of the original gain value G and the default data-gain conversion relationship lookup table, and determines the higher gain range and the lower gain range according to the specific gain value. A higher boundary gain value of the lower gain range is lower than or equal to the specific gain value, and a lower boundary gain value of the higher gain range is higher than or equal to the specific gain value. In some embodiments, the conversion relationship generator 820 may take the original gain value G as the specific gain value.

In the high grayscale range at least covering the highest grayscale value applied by the image processing device, at least one corresponding default gain value on the default data-gain conversion relationship lookup table is 1. In the low grayscale range at least covering the lowest grayscale value applied by the image processing device, at least one corresponding default gain value on the default data-gain conversion relationship lookup table is higher than the original gain value G.

Taking FIG. 7 as an example, in the step S730, a part (lower gain boundary range) of the default conversion relationship curve 910 having higher grayscale values (for example, greater than the intersection 940) is set as a lower gain range part of the adjusted conversion relationship curve 950, where the lower boundary gain value (for example, a gain value of 1) of the lower gain range corresponds to the highest grayscale value (for example, a grayscale value of 255) applied by the image processing device. In the step S730, a part (higher gain boundary range) of the original conversion relationship curve 920 (i.e. the original gain value) having lower grayscale values (for example, smaller than the intersection 940) is set as a higher gain range part of the adjusted conversion relationship curve 950, where the higher boundary gain value of the higher gain range corresponds to the lowest grayscale value (for example, a grayscale value of 0) applied by the image processing device. In the high grayscale range covering the highest grayscale value (for example, the grayscale value of 255), at least one corresponding default gain value on the default conversion relationship curve 910 is 1. In the low grayscale range covering the lowest grayscale value (for example, the grayscale value of 0), the corresponding default gain value on the default conversion relationship curve 910 is higher than the original gain value G.

The conversion circuit 830 is coupled to the conversion relationship generator 820. In the step S740, the conversion circuit 830 can perform the gain processing on the image data of the image frame according to the adjusted data-gain conversion relationship of the step S730.

Figure 10:
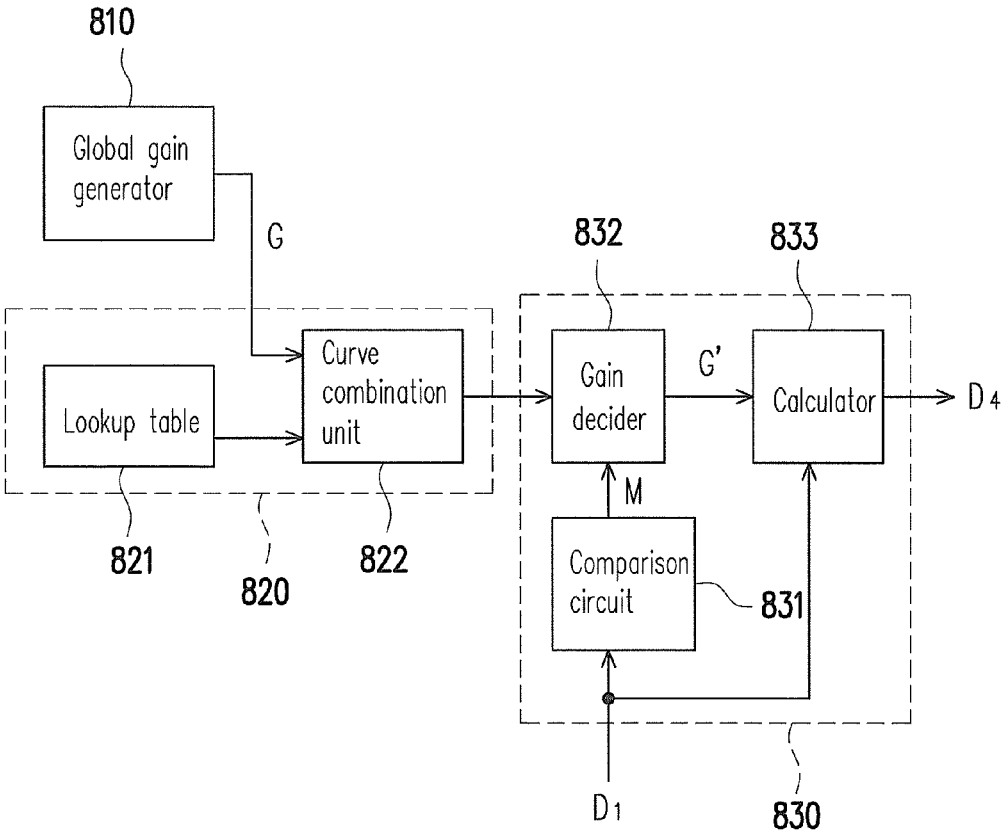
FIG. 10 is a circuit block diagram of an image processing device according to still another embodiment of the invention.

FIG. 10 is a circuit block diagram of an image processing device according to still another embodiment of the invention. Description of the embodiment of FIG. 10 can be deduced according to related description of the embodiment of FIG. 8. A difference between the embodiments of FIG. 8 and FIG. 10 is that the conversion relationship generator 820 of FIG. 8 includes a lookup table 821 and a curve combination unit 822. Referring to FIG. 7, FIG. 9 and FIG. 10, the lookup table 821 can record and provide the default conversion relationship curve 910 to the curve combination unit 822 (step S720). The curve combination unit 822 is coupled to the lookup table 821 and the global gain generator 810. In the step S730, the curve combination unit 822 selects a part of the default conversion relationship curve 910 that is smaller than the original value G (for example, 1.6, which is determined by the global gain generator 810), and selects a part of the original conversion relationship curve 920 with the image data $D_1$ smaller than the intersection 940 to serve as the adjusted conversion relationship curve 950 (i.e. the adjusted data-gain conversion relationship), and provides the adjusted conversion relationship curve 950 to the conversion circuit 830.

In some embodiments, the conversion circuit 830 includes a gain decider 832 and a calculator 833. The gain decider 832 is coupled to the conversion relationship generator 820. The gain decider 832 obtains a plurality of grayscale values of the image frame, and obtains a plurality of adjusted gain values G' respectively corresponding to the grayscale values of the image frame according to the adjusted data-gain conversion relationship of the step S730. The calculator 833 is coupled to the gain decider 832. The calculator 833 respectively performs the gain processing on the grayscale values of the image frame by using the adjusted gain values G' (step S740).

In some other embodiments, the conversion circuit 830 of FIG. 8 may further include a comparison circuit 831 coupled to the gain decider 832. The comparison circuit 831 receives the original image data $D_1$, and obtains a representative grayscale value M of each pixel unit to serve as one of the grayscale values according to a plurality of grayscale values of the sub pixels of each pixel unit in the original image data $D_1$. The gain decider 832 receives the representative grayscale value M provided by the comparison circuit 831, and obtains the adjusted gain values G' respectively corresponding to the representative grayscale values M of the pixel units according to the adjusted data-gain conversion relationship of the step S730. The calculator 833 respectively performs the gain processing on the corresponding grayscale values in the original image data $D_1$ by using the adjusted gain values G' (step S740).

Implementation of the comparison circuit 831 is not limited by the invention. For example, the comparison circuit 831 can respectively find the highest grayscale value from a plurality of grayscale values of the sub pixels of each pixel unit to serve as the representative grayscale value M of the pixel unit. For example, it is assumed that the original image data $D_1$ is pixel unit data, and the pixel unit data includes red (R), green (G) and blue (B) sub pixel data, the comparison circuit 831 can select the maximum value (the highest grayscale value) from the three batches of R, G, B sub pixel data of the same pixel unit to serve as the representative grayscale value M of the pixel unit. The gain decider 832 is coupled to the comparison circuit 831 to receive the representative grayscale value M. The gain decider 832 finds the adjusted gain values G' from the adjusted data-gain conversion relationship (for example, the adjusted conversion relationship curve 950 of FIG. 7) provided by the conversion relationship generator 820 according to the representative grayscale value M.

The calculator 833 is coupled to the gain decider 832 to receive the adjusted gain values G'. The calculator 833 can calculate the gained image data $D_4$ by using the adjusted gain value G' provided by the gain decider 832 and the original image data $D_1$. The method that the calculator 833 calculates the gained image data $D_4$ is not limited by the invention. For example, the calculator 833 may include a multiplier, where the multiplier can calculate a multiplication (i.e. $G'*D_1$) of the adjusted gain value G' and the original image data $D_1$ to serve as the image data $D_4$. The calculator 833 can output the image data $D_4$ to a display circuit (not shown). The display circuit can display a corresponding image frame as the image data $D_4$ drives a display panel (not shown).

The method shown in FIG. 4 can also be applied to the image processing device shown in FIG. 10. Referring to FIG. 4, FIG. 8 and FIG. 9, in the step S410, the global gain generator 810 analyzes the image frame to obtain the original gain value G (i.e. the original conversion relationship curve) corresponding to a plurality of grayscale values of the image frame. For example, taking FIG. 6 as an example, the original gain value G of the step S410 can be the original conversion relationship curve 610. Taking FIG. 7 as an example, the original gain value G of the step S410 can be the original conversion relationship curve 920.

In the step S420, the conversion relationship generator 820 further obtains the default conversion relationship curve. For example, taking FIG. 6 as an example, the default conversion relationship curve of the step S420 can be the curve 620 shown in FIG. 6. Taking FIG. 7 as an example, the default conversion relationship curve of the step S420 can be the curve 910 of FIG. 7. The lookup table 821 may record and provide the default conversion relationship curve.

The curve combination unit 822 is coupled to the lookup table 821 and the global gain generator 810. In the step S430, the curve combination unit 822 selects a part of line segment of the original conversion relationship curve with grayscale values lower than the intersection grayscale value corresponding to the intersection of the default conversion relationship curve and the original conversion relationship curve to serve as a first part of the adjusted conversion relationship curve. In the step S430, the curve combination unit 822 selects a part of line segment of the default conversion relationship curve with grayscale values higher than the intersection grayscale value to serve as a second part of the adjusted conversion relationship curve. For example, taking FIG. 6 as an example, in the step S430, the curve combination unit 822 selects a part of line segment of the original conversion relationship curve 610 with grayscale values lower than the intersection grayscale value corresponding to the intersection 630 to serve as the first part of the adjusted conversion relationship curve, and selects a part of line segment of the default conversion relationship curve 620 with grayscale values higher than the intersection grayscale value corresponding to the intersection 630 to serve as the second part of the adjusted conversion relationship curve. Taking FIG. 7 as an example, in the step S430, the curve combination unit 822 selects a part of line segment of the original conversion relationship curve 920 with grayscale values lower than the intersection grayscale value corresponding to the intersection 940 to serve as the first part of the adjusted conversion relationship curve 950, and selects a part of line segment of the default conversion relationship curve 910 with grayscale values higher than the intersection grayscale value corresponding to the intersection 940 to serve as the second part of the adjusted conversion relationship curve 950.

In summary, in the present embodiment, adjustment is performed on the gain, and a default conversion relationship curve (for example, the curve 620 of FIG. 6 or the curve 910 of FIG. 7) is set as the maximum gain value that can be accepted by the system. The conversion relationship generator 820 can combine the default conversion relationship curve and the original conversion relationship curve (for example, the curve 610 of FIG. 6 or the curve 920 of FIG. 7) representing the original gain value G to obtain the adjusted conversion relationship curve. According to the maximum one of the three batches of R, G and B sub pixel data in the image data $D_1$, the conversion circuit 830 finds the adjusted gain value G' from the default conversion relationship curve 950. The adjusted gain value G' is adapted to the three batches of R, G and B sub pixel data in the image data $D_1$. Tacking FIG. 7 as an example, since the gain value of the adjusted conversion relationship curve 950 in the high grayscale value (high brightness) range of the image data $D_1$ is converged to 1, it is ensured that the three batches of R, G and B sub pixel data in the gained image data $D_4$ do not have the phenomenon of "saturation", so as to achieve an effect of maintaining high brightness details.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An anti-saturation method for image data, adapted to an image processing device to perform an image processing, comprising:

analyzing, by a global gain generator, one of a plurality of image frames to obtain an original conversion relationship curve of the image frame, and the original conversion relationship curve representing a gain processing of a plurality of grayscale values of the image frame commonly according to an original gain value, wherein the original gain value is greater than 1;

obtaining a default conversion relationship curve by a conversion relationship generator coupled to the global gain generator, wherein the default conversion relationship curve is commonly used for performing an anti-saturation processing on image data of the image frames;

combining, by the conversion relationship generator, the default conversion relationship curve and the original conversion relationship curve to perform the anti-saturation processing on the image frame, so as to obtain an adjusted conversion relationship curve; and performing a gain processing on the image data of the image frame according to the adjusted conversion relationship curve by a conversion circuit coupled to the conversion relationship generator.

2. The anti-saturation method for image data as claimed in claim 1, wherein each of the original conversion relationship curve, the default conversion relationship curve and the adjusted conversion relationship curve is a data-gain curve.

3. The anti-saturation method for image data as claimed in claim 2, wherein in a high grayscale range at least covering a highest grayscale value applied by the image processing device, at least one corresponding gain value on the default conversion relationship curve is greater than 0 and is smaller than or equal to 1.

4. The anti-saturation method for image data as claimed in claim 2, wherein in a low grayscale range at least covering a lowest grayscale value applied by the image processing device, at least one corresponding gain value on the default conversion relationship curve is higher than the original gain value.

5. The anti-saturation method for image data as claimed in claim 2, wherein the original conversion relationship curve is a horizontal line passing through the original gain value.

6. The anti-saturation method for image data as claimed in claim 2, wherein image data of different colors of the image frame uses different default conversion relationship curves.

7. The anti-saturation method for image data as claimed in claim 1, wherein each of the original conversion relationship curve, the default conversion relationship curve and the adjusted conversion relationship curve is a data-data curve respectively defining a corresponding relationship between a grayscale value before a gain conversion and the grayscale value after the gain conversion.

8. The anti-saturation method for image data as claimed in claim 7, wherein in a high grayscale range at least covering a highest grayscale value applied by the image processing device, a slope of the default conversion relationship curve is greater than 0 and is smaller than or equal to 1.

9. The anti-saturation method for image data as claimed in claim 7, wherein the original conversion relationship curve and the default conversion relationship curve have an intersection, within a low grayscale value range where the grayscale values before conversion are smaller than an intersection grayscale value corresponding to the intersection, the converted grayscale values on the original conversion relationship curve are all smaller than or equal to the converted gain values on the default conversion relationship curve; and within a high grayscale value range where the grayscale values before conversion are greater than the intersection grayscale value, the converted grayscale values on the original conversion relationship curve are all greater than or equal to the converted gain values on the default conversion relationship curve.

10. The anti-saturation method for image data as claimed in claim 7, wherein the original conversion relationship curve comprises an oblique line with a slope equal to the original gain value and a horizontal line with a slope equal to 0.

11. The anti-saturation method for image data as claimed in claim 7, wherein image data of different colors of the image frame uses the same default conversion relationship curve.

12. The anti-saturation method for image data as claimed in claim 1, wherein the step of combining the default conversion relationship curve and the original conversion relationship curve to perform the anti-saturation processing on the image frame, so as to obtain the adjusted conversion relationship curve comprises:

selecting, by a curve combination unit of the conversion relationship generator, a part of the original conversion relationship curve with the grayscale values lower than an intersection grayscale value corresponding to an intersection of the default conversion relationship curve and the original conversion relationship curve to serve as a first part of the adjusted conversion relationship curve; and selecting, by the curve combination unit, a part of the default conversion relationship curve with grayscale values higher than the intersection grayscale value to serve as a second part of the adjusted conversion relationship curve.

13. The anti-saturation method for image data as claimed in claim 1, further comprising:

performing a smooth processing to the adjusted conversion relationship curve by the conversion relationship generator, such that a part of line segment on the adjusted conversion relationship curve covering the original conversion relationship curve and the default conversion relationship curve have a smooth connection.

14. The anti-saturation method for image data as claimed in claim 13, wherein the smooth processing comprises a low-pass filtering processing.

15. An image processing device, configured to perform an image processing, the image processing device comprising:

a global gain generator, analyzing one of image frames to obtain an original conversion relationship curve of the image frame, wherein the original conversion relationship curve represents a gain processing of a plurality of grayscale values of the image frame commonly according to an original gain value, wherein the original gain value is greater than 1;

a conversion relationship generator, coupled to the global gain generator for receiving the original gain value, and obtaining a default conversion relationship curve, wherein the default conversion relationship curve is commonly used for performing an anti-saturation processing on image data of the image frames, and the conversion relationship generator combines the default conversion relationship curve and the original conversion relationship curve to perform the anti-saturation processing on the image frame, so as to obtain an adjusted conversion relationship curve; and a conversion circuit, coupled to the conversion relationship generator, and performing a gain processing on the image data of the image frame according to the adjusted conversion relationship curve.

16. The image processing device as claimed in claim 15, wherein each of the original conversion relationship curve, the default conversion relationship curve and the adjusted conversion relationship curve is a data-gain curve.

17. The image processing device as claimed in claim 16, wherein in a high grayscale range at least covering a highest grayscale value applied by the image processing device, at least one corresponding gain value on the default conversion relationship curve is greater than 0 and is smaller than or equal to 1.

18. The image processing device as claimed in claim 16, wherein in a low grayscale range at least covering a lowest grayscale value applied by the image processing device, at least one corresponding gain value on the default conversion relationship curve is higher than the original gain value.

19. The image processing device as claimed in claim 16, wherein the original conversion relationship curve is a horizontal line passing through the original gain value.

20. The image processing device as claimed in claim 16, wherein image data of different colors of the image frame uses different default conversion relationship curves.

21. The image processing device as claimed in claim 15, wherein each of the original conversion relationship curve, the default conversion relationship curve and the adjusted conversion relationship curve is a data-data curve respectively defining a corresponding relationship between a grayscale value before a gain conversion and the grayscale value after the gain conversion.

22. The image processing device as claimed in claim 21, wherein in a high grayscale range at least covering a highest grayscale value applied by the image processing device, a slope of the default conversion relationship curve is greater than 0 and is smaller than or equal to 1.

23. The image processing device as claimed in claim 21, wherein the original conversion relationship curve and the default conversion relationship curve have an intersection;

within a low grayscale value range where the grayscale values before conversion are smaller than an intersection grayscale value corresponding to the intersection, the converted grayscale values on the original conversion relationship curve are all smaller than or equal to the converted gain values on the default conversion relationship curve; and within a high grayscale value range where the grayscale values before conversion are greater than the intersection grayscale value, the converted grayscale values on the original conversion relationship curve are all greater than or equal to the converted gain values on the default conversion relationship curve.

24. The image processing device as claimed in claim 21, wherein the original conversion relationship curve comprises an oblique line with a slope equal to the original gain value and a horizontal line with a slope equal to 0.

25. The image processing device as claimed in claim 21, wherein image data of different colors of the image frame uses the same default conversion relationship curve.

26. The image processing device as claimed in claim 15, wherein the conversion relationship generator comprises:

a lookup table, providing the default conversion relationship curve; and a curve combination unit, coupled to the lookup table and the global gain generator, wherein the curve combination unit selects a part of the original conversion relationship curve with the grayscale values lower than an intersection grayscale value corresponding to an intersection of the default conversion relationship curve and the original conversion relationship curve to serve as a first part of the adjusted conversion relationship curve, and the curve combination unit selects a part of the default conversion relationship curve with grayscale values higher than the intersection grayscale value to serve as a second part of the adjusted conversion relationship curve.

27. The image processing device as claimed in claim 15, wherein the conversion relationship generator performs a smooth processing to the adjusted conversion relationship curve, such that a part of line segment on the adjusted conversion relationship curve covering the original conversion relationship curve and the default conversion relationship curve have a smooth connection.

28. The image processing device as claimed in claim 27, wherein the smooth processing comprises a low-pass filtering processing.

29. The image processing device as claimed in claim 15, wherein the conversion circuit comprises:

a comparison circuit, obtaining a representative grayscale value of each of the pixel units to serve as one of the grayscale values according to a plurality of grayscale values of the sub pixels of each of the pixel units;

a gain decider, coupled to the conversion relationship generator and the comparison circuit, wherein the gain decider obtains the representative grayscale value, and obtains a plurality of adjusted gain values respectively corresponding to the representative grayscale value of the pixel units according to the adjusted conversion relationship curve; and a calculator, coupled to the gain decider, wherein the calculator respectively performs a gain processing on the grayscale values of the image frame by using the adjusted gain values.

30. The image processing device as claimed in claim 29, wherein the comparison circuit finds a highest grayscale value from the grayscale values of the sub pixels of each of the pixel units to serve as the representative value of the pixel unit.

* * * * *